United States Patent [19]

Shaw

[11] Patent Number: 4,895,186

[45] Date of Patent: Jan. 23, 1990

[54] UNIVERSAL TRANSPORT MECHANISM FOR AUXILIARY DEVICES IN WEAVING MILLS

[75] Inventor: Henry Shaw, Vleteren, Belgium

[73] Assignee: Picanol N.V., Ieper, Belgium

[21] Appl. No.: 210,939

[22] Filed: Jun. 24, 1988

[30] Foreign Application Priority Data

Jun. 29, 1987 [BE] Belgium ..... 8700724

[51] Int. Cl.[4] ..... D03J 1/00

[52] U.S. Cl. ..... 139/1 C; 15/312 R; 212/210

[58] Field of Search ..... 139/1 R, 1 C; 15/312 R, 15/312 A; 134/172; 66/168; 212/205, 210

[56] References Cited

U.S. PATENT DOCUMENTS

| | | | |
|---|---|---|---|
| 864,935 | 9/1907 | Taylor | 212/205 |
| 2,812,251 | 11/1957 | Miller et al. | 139/1 C |
| 3,018,503 | 1/1962 | Hijiya et al. | 15/312 R |
| 4,609,323 | 9/1986 | Blaseck et al. | 212/210 |

*Primary Examiner*—Henry S. Jaudon

*Attorney, Agent, or Firm*—Bacon & Thomas

[57] ABSTRACT

A universal transport mechanism for auxiliary devices in weaving mills, including a single rail mounted above the weaving machines, and two or more guides along which respective auxiliary devices can travel unhindered by each other.

10 Claims, 2 Drawing Sheets

UNIVERSAL TRANSPORT MECHANISM FOR AUXILIARY DEVICES IN WEAVING MILLS

BACKGROUND OF THE INVENTION

This invention concerns a universal transport mechanism for auxiliary devices in weaving mills, in particular a device which enables such auxiliary devices to travel along several machines. By auxiliary devices is meant for example a cleaning device, or devices for automatic thread repair, etc.

It is common technology for cleaning devices for weaving machines to travel along a rail extending above the weaving machines. It is also common for thread repair devices to travel along rails.

It is clear that with further automation of weaving mills, it will be necessary to be able to present more and more auxiliary devices to parts of the weaving machine, in order to carry out automatic repairs, deliver yarn packages and so forth. As a result, it may be necessary to install several rail systems above and alongside the weaving machines in order to enable all the devices to be properly presented to the weaving machine. However, such an arrangement would have the disadvantage that access to the weaving machine would be severely restricted.

SUMMARY OF THE INVENTION

The present invention concerns a transport mechanism for auxiliary devices in weaving mills which does not have the disadvantage of requiring several rail systems to move a corresponding number of auxiliary devices between weaving machines.

For this purpose it consists essentially of one single rail mounted above the weaving machine, with several guides along which several auxiliary devices can travel past each other unhindered.

BRIEF DESCRIPTION OF THE DRAWINGS

In order to explain the characteristics of the invention, the following preferred embodiments are described, by way of example only and without being limitative in any way, with reference to the accompanying drawings, where.

DETAILED DESCRIPTION OF THE PREFERRED EMBODIMENT

Figure 1:
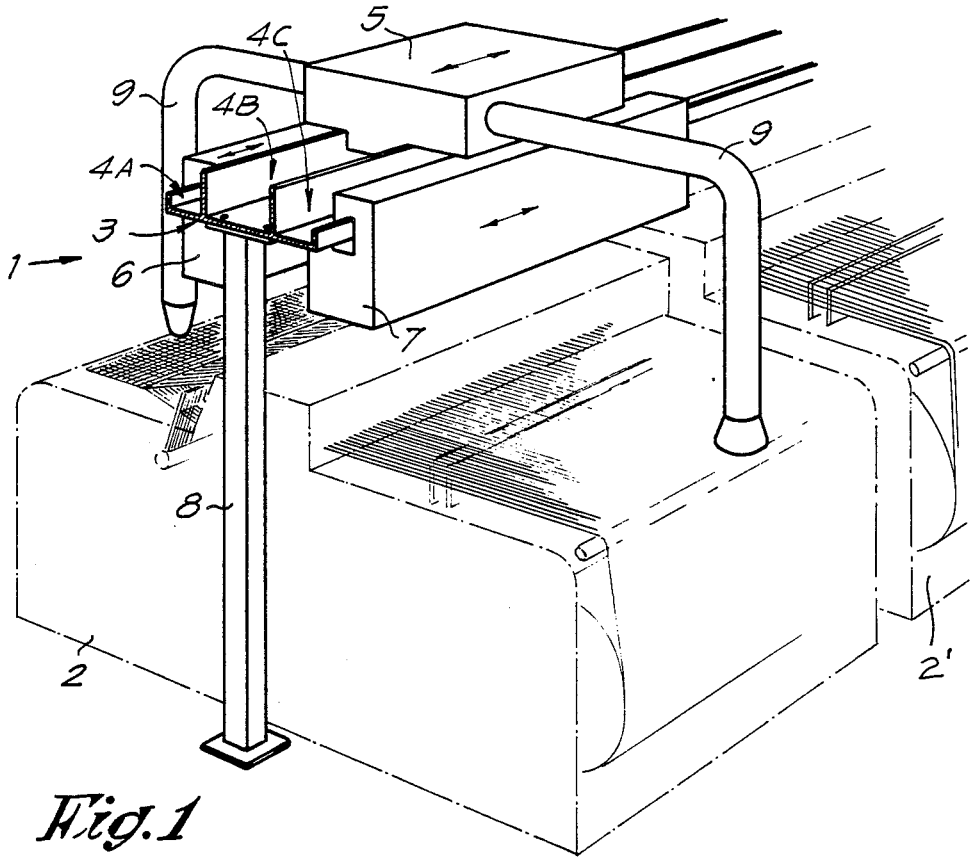
FIG. 1 is a perspective view of the transport mechanism according to the invention.

As shown in FIG. 1, the transport mechanism 1 according to the invention consists essentially of one single rail 3 having a longitudinal axis mounted above the weaving machines 2 and 2', with several guides 4A, 4B and 4C along which several auxiliary devices 5, 6 and 7 respectively can travel past each other unhindered as they move along the single rail 3 between the weaving machines. In the most preferred embodiment, the rail 3 is supported by vertical stanchions 8 fixed to the ground between the weaving machines. In a variant, the rail could also be suspended from the roof of the weaving mill.

Although FIG. 1 depicts only two weaving machines, it will be appreciated that any number of weaving machines could be serviced by rail 3. If all weaving machines were in a single row as shown, the rail would, of course, simply be extended in a straight line to follow the row. If a second row of machines were added, the rail would make a u-turn and extend along the second row in the same manner as shown in FIG. 1. Similarly, the single rail could even service a room full of weaving machines randomly arranged by following a suitable zigzag pattern, as one skilled in the art would clearly recognize.

As shown in FIG. 1, the rail is preferably designed so that the most central guide 4B carries the cleaning device 5 which with its wide arms 9 can easily move over the other auxiliary devices in order to pass them during travel among the machines.

As shown in FIG. 1; the guides **4*a*, 4*b* and 4*c* intersect the respective vertical planes that include the respective parts an the weaving machine upon which the auxiliary devices, i.e. cleaning arms 9 and devices 6 and 7**, operate.

Figure 4:
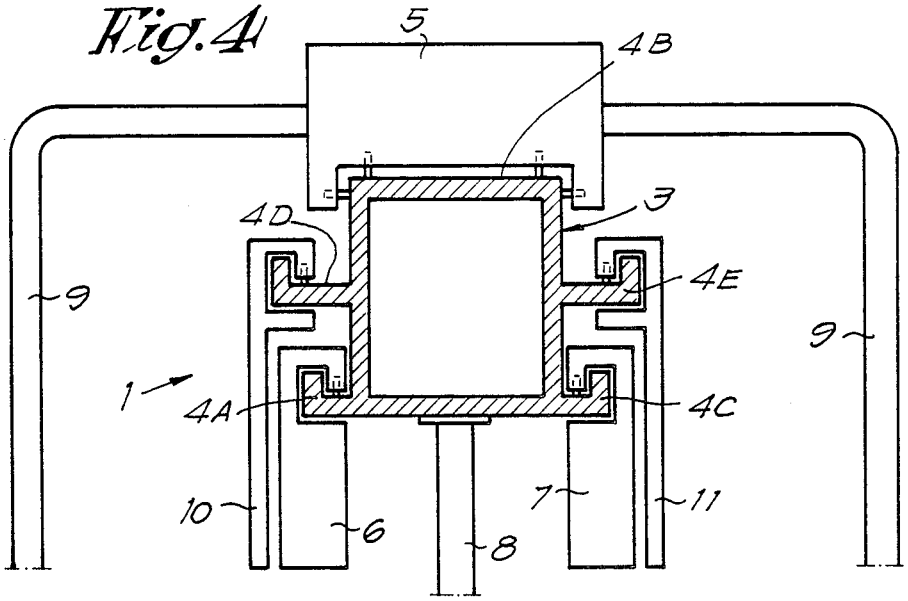
FIGS. 3 and 4 show two variants of the embodiment shown in FIG. 2.
Figure 3:
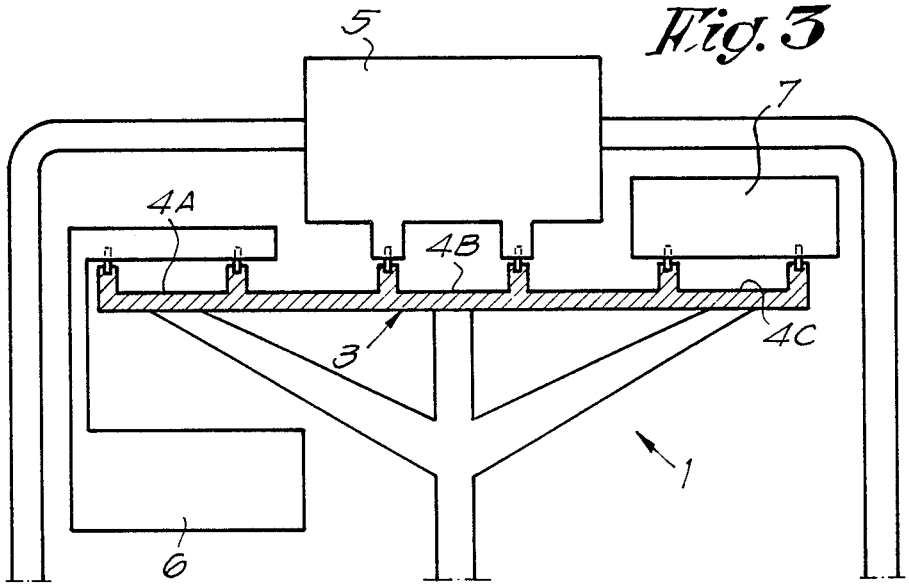

It is clear from this FIG. and from FIGS. 1, 3 & 4 that the cleaning device 5 including arms 9 can easily pass over devices 6 and 7 without hindrance, and that devices 6 and 7 can easily pass each other.

Figure 2:
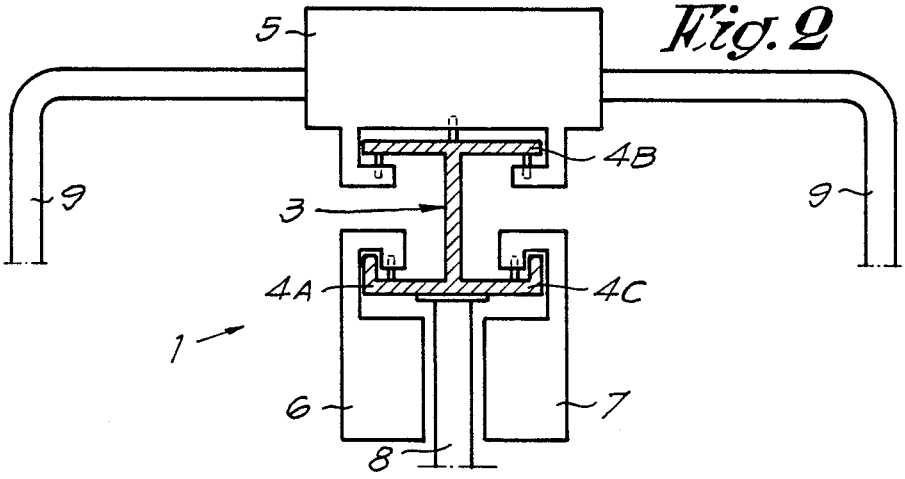
FIG. 2 shows a practical embodiment as a cross-section through the rail.

FIG. 2 shows a variant in which the rail 3 consists of an I section whose flanges form the guides 4A to 4C.

FIG. 3 shows yet another variant in which the various guides 4A to 4C of the rail 3 are arranged side by side.

Finally, FIG. 4 shows a variant for five auxiliary devices 5, 6, 7, 10 and 11 which operate with guides 4A, 4B, 4C, 4D and 4E respectively, where the auxiliary devices consist of, for example, respectively an automatic weft thread repair device, a cleaning device, a device for repairing warp thread breaks, a separate cleaning system for the reed and a package delivery system.

Guides 4A to 4E are positioned so that each auxiliary device finds itself above the part of the weaving machine on which it must operate. For example, an automatic thread repair device must be positionable, above the location of a broken thread, which means that the guide must be located above potential broken thread locations.

It should be noted that the manner in which the devices are supported by the rails, and the mode of propulsion, may take numerous forms. Essentially, any of the bearings and conveyance systems used in connection with the prior art multiple rail arrangements can be used with the single rail of the invention.

The present invention is in no way limited to the embodiments described by way of example and shown in the drawings; on the contrary, such a universal transport mechanism for auxiliary devices in weaving machines can be made in many forms and dimensions while still remaining within the scope of the invention.

I claim:

1. A universal transport mechanism for auxiliary devices in weaving mills including a plurality of weaving machines, comprising one single rail mounted above, and extending between the weaving machines and fixed relative to the weaving machines, said rail including a central axis about which a plurality of spaced guides are arranged to permit said auxiliary devices to travel past each other between weaving machines unhindered as the auxiliary devices move along the single rail to operate on a plurality of weaving machines.

2. A universal transport mechanism for auxiliary devices in weaving mills as claimed in claim 1, wherein said guides intersect the respective vertical planes including the parts of the weaving machine upon which the respective auxiliary devices operate.

3. A universal transport mechanism for auxiliary devices in weaving mills as claimed in claim 1, said guides being spaced from said axis and including a generally central guide; wherein said generally central guide is arranged to carry a general cleaning device for the weaving machines.

4. A universal transport mechanism for auxiliary devices in weaving mills as claimed in claim 1, wherein the single rail includes support means located along the central axis of said rail for supporting the rail.

5. A universal transport mechanism for auxiliary devices in weaving mills as claimed in claim 4, wherein said support means includes vertical supports extending from the floor of the weaving mill to said single rail.

6. A universal transport mechanism for auxiliary devices in weaving mills as claimed in claim 1, wherein at least two of said guides are spaced laterally in respect to said central axis.

7. A universal transport mechanism for auxiliary devices in weaving mills as claimed in claim 1, wherein at least two of said guides are spaced vertically in respect to said central axis.

8. A universal transport mechanism for auxiliary devices in weaving mills as claimed in claim 7, wherein at least two of said guides are spaced laterally in respect to said central axis, thereby permitting at least three of said auxiliary devices to pass each other unhindered.

9. A universal transport mechanism is claimed in claim 1, wherein the number of said devices which are permitted to travel past each other unhindered is at least three.

10. A universal transport mechanism as claimed in claim 1, wherein each of said guides carries a single one of said auxiliary devices.

* * * * *